United States Patent [19]

Fish

[11] 4,262,817

[45] Apr. 21, 1981

[54] ELEVATOR MECHANISM FOR AUTOMATIC TELLER MACHINE

[75] Inventor: Leonard A. Fish, Chicago, Ill.

[73] Assignee: Bank Computer Network Corporation, Schiller Park, Ill.

[21] Appl. No.: 966,746

[22] Filed: Dec. 5, 1978

[51] Int. Cl.[3] ..... B65H 3/44

[52] U.S. Cl. ..... 221/130; 221/192; 198/422; 271/9; 271/212; 414/268

[58] Field of Search ..... 221/12, 129, 130, 133, 221/151, 152, 154, 192, 248, 253, 255; 271/9, 10, 212; 198/420, 422; 414/267, 268, 281; 194/DIG. 26

[56] References Cited

U.S. PATENT DOCUMENTS

| | | | |
|---|---|---|---|
| 1,793,062 | 2/1931 | Collier | 221/253 X |
| 1,829,317 | 10/1931 | Waechter | 198/796 X |
| 3,828,166 | 8/1974 | Johansson et al. | 194/DIG. 26 |
| 4,017,004 | 4/1977 | Onoe et al. | 221/192 X |

FOREIGN PATENT DOCUMENTS

| | | | |
|---|---|---|---|
| 1000605 | 8/1965 | United Kingdom | 221/129 |

*Primary Examiner*—F. J. Bartuska

*Attorney, Agent, or Firm*—Hill, Van Santen, Steadman, Chiara & Simpson

[57] ABSTRACT

An elevator mechanism for an automatic teller machine, equipped with a plurality of bill dispensing modules for dispensing bills at a plurality of elevations, incorporates a tray adapted to be raised and lowered by drive apparatus, the tray being rotatably mounted on a bracket and adapted to normally assume a horizontal position during its upward motion, during which it collects bills dispensed from the bill dispensing modules, an access door located at the top of the elevator assembly and an assembly for unlocking and lifting the door as the tray reaches its upper position. The tray is tilted during its downward movement so that any remaining contents of the tray are deposited into an escrow compartment.

3 Claims, 6 Drawing Figures

FIG 6
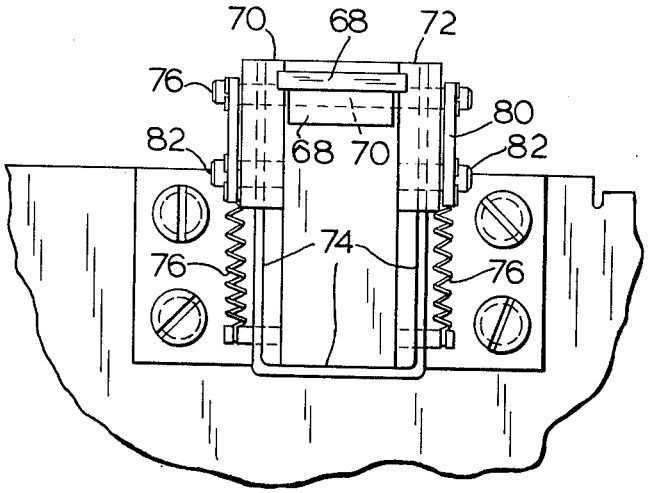
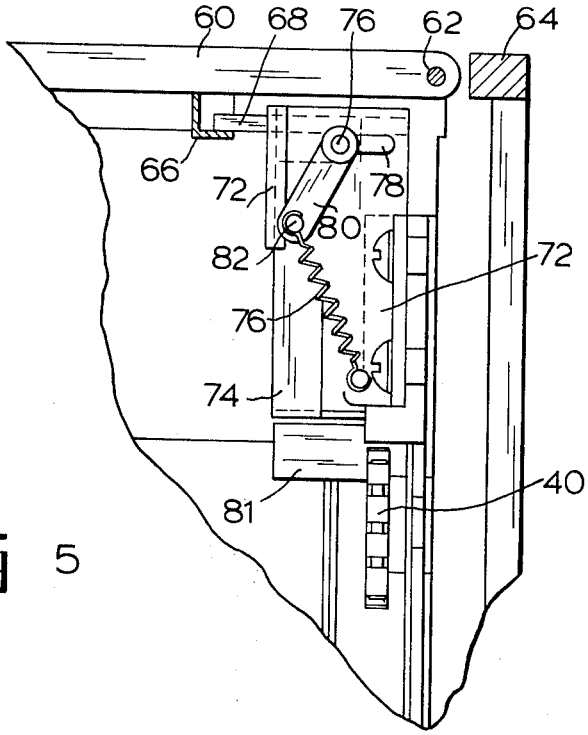
FIG 5

ELEVATOR MECHANISM FOR AUTOMATIC TELLER MACHINE

BACKGROUND OF THE INVENTION

1. Field of the Invention

The present invention relates to elevator mechanisms for automatic teller machines, and particularly to automatic teller machines which employ a plurality of bill dispensers for dispensing bills at different elevations, such that the bills must be collected before they can be made available to operator at and access compartment.

2. The Prior Art

Conventionally, automatic teller machines are relatively large and bulky, because of their use of large and bulby mechanisms for dispensing prepackaged packets of money in prearranged quantities.

In an automatic teller machine of the type described and claimed in the copending Fish application Ser. No. 966,581, filed contemporaneously herewith, the dispensing mechanism incorporates a plurality of bill dispensers arranged in side-by-side pairs at three different vertical levels. A collection assembly is therefore necessary to collect the bills dispensed at each of the levels, and to make the collected bills available to an operator at an access compartment located near the top of the machine.

BRIEF DESCRIPTION OF THE INVENTION

It is a principle object of the present invention to provide an elevator mechanism which functions as a collection assembly, for collecting bills dispensed at a plurality of levels and making them available in assembled condition at an access compartment accessible to the operator of the machine.

Another object of the present invention is to provide a normally locked door closing the access compartment, with means for automatically unlocking the access door when the elevator reaches its upper position, when the collected bills are in the access compartment.

A further object of the present invention is to provide an escrow compartment for receiving any bills left on the elevator tray when it returns to its initial downward position, from the access compartment.

These and other objects of the present invention will become manifest by an examination of the following specification and accompanying drawings.

In one embodiment of the present invention there is provided an elevator tray, with means for raising it along a vertical line while maintaining the tray in a generally horizontal condition, said tray moving upwardly passed a plurality of bill holding fingers for temporary holding bills dispensed at a plurality of different elevations. The fingers are adapted to hold the bills, temporarily, in a horizontal condition and to pivot about horizontal axes as the tray moves upward past the fingers. The fingers pivot back to their normal bill-holding positions when the tray moves downwardly toward its lower position after the collection process has been completed.

As the tray moves downwardly toward its lower position, it is momentarily tilted into an inclined position, so that an residual contents of the tray slides into a escrow compartment provided therefore.

Means is provided for raising the tray to a level corresponding to the highest point of its supporting bracket when the elevator is in its upper position, and for lowering the tray to a position substantially below the upper portion of the bracket when it is at its lower position.

BRIEF DESCRIPTION OF THE DRAWINGS

Reference will now be made to the accompanying drawings in which:

FIG. 5 is a side elevation view, partly in cross section, of a mechanism for unlocking and lifting an acess door when the elevator reaches its top of travel; and FIG. 6 is a part view, partly in cross section, of a part of the apparatus shown in FIG. 5.

DESCRIPTION OF THE PREFERRED EMBODIMENT

Figure 1:
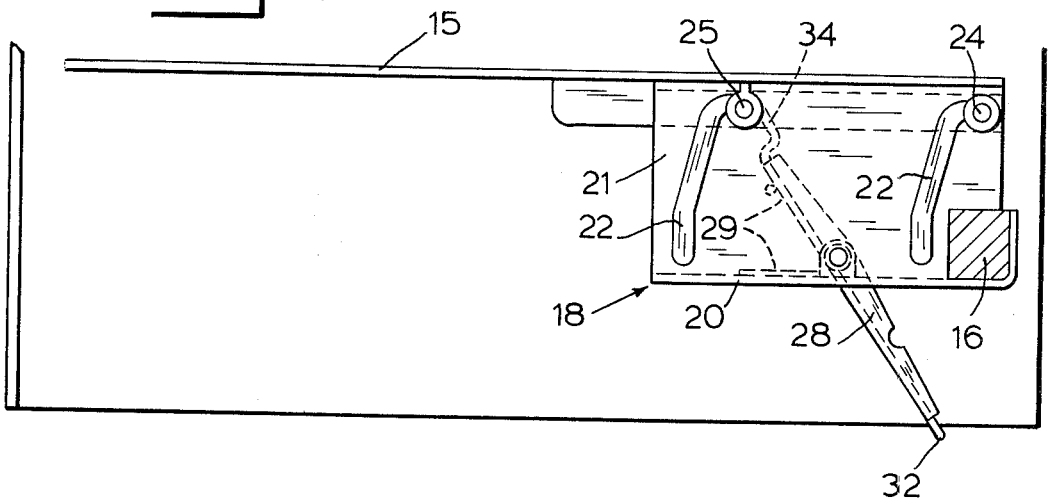
FIG. 1 is a side view, partly in cross section, of a portion of an elevator assembly incorporating an illustrative embodiment of the present invention, when the tray is its upper position.

Referring now to the drawings, there is illustrated an elevator mechanism which is suitable for use with the automatic teller machine disclosed and claimed in the above identified Fish application, the disclosure of which is incorporated here into by reference.

In the automatic teller machine as there described, a plurality of dispensing modules is provided, with a pair of modules being disposed at each of three different vertical elevations. The dispensing modules are separated from the elevator assembly by means of a vertical wall formed of steel plate. Apertures with the dispensing apertures of the dispensing modules, enables bills to pass through the wall into the elevator compartment. A positive drive roller is interposed between each dispensing module and the elevator assembly, to ensure the positive feeding of bills into the elevator compartment.

The elevator assembly of the present invention is disposed adjacent the positive drive roller, for receiving and temporarily holding bills dispensed therethrough, and for collecting the bills on an elevator tray during upward movement of such tray so that the collected bills can be presented to an operator at an access compartment at the top of the elevator assembly.

Figure 3:
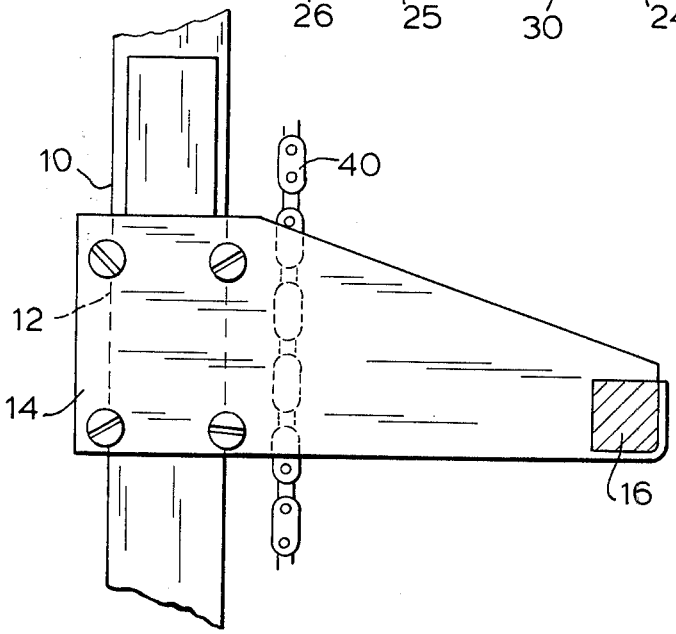
FIG. 3 is a front view of an elevator assembly incorporating in the present invention, illustrating the mechanism for raising and lowering the elevator assembly.

FIG. 3 illustrates a front view of a portion of the elevator assembly, illustrating especially, a vertical slide 10 disposed at the rear of the elevator compartment and on which a guide member 12 is mounted in vertical sliding relationship. A bracket 14 is bolted to the guide member 12, and a supporting bar 16 is firmly attached to the end of the bracket 14 and extends transversely therefrom, horizontally from the rear of the elevator compartment toward the front. Two elevator trays are pivotally supported by the bar 16 by apparatus which will now be described.

FIG. 1 illustrates a side view of one of the elevator trays 15. A bracket 18, having a pair of vertical walls 21 is secured to the bar 16 by convenient means such as screws, bolts or the like. One of the side walls 21 is shown in FIG. 1. Both of the walls 21 extend upwardly generally in vertical planes and are parallel to each other on opposite sides of the tray 15. A pair of slots 22 is provided in both of the side walls 21, and a pair of shafts 24 and 25 are received in the slots. An inverted U-shaped stop member 26 is provided with apertures for receiving the shafts 24 and 25 and is supported thereby. As illustrated in FIG. 1, the shafts 24 and 25 are in their upper position at the extreme upper end of the slots 22, and the stop member 26 has a generally horizontal upper surface when the shafts are in this position. The tray 15 is pivotally mounted on the shaft 24, but vertically assumes a flat position, resting on top of the stop member 26.

Figure 2:
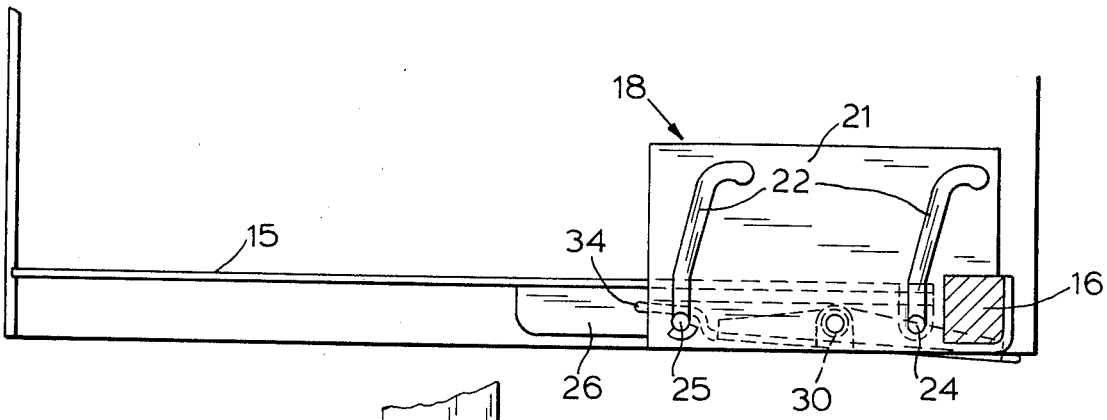
FIG. 2 is a front view, partly in cross section, of the apparatus illustrated in FIG. 1 with the tray shown in its lower position.

The stop member 26 is normally urged to its upper position as illustrated in FIG. 1 by action of a lever member 28, pivoted about a horizontal shaft 30 mounted in fixed relation to the bottom wall 20. A torsion spring 29 surrounds the shaft 30 and has one of its ends bearing against the bottom wall 20 and the other end urging the lever member 28 in a counterclockwise direction, so that the upper end of the lever is urged against the bottom of the stop member 26 and forces it upwardly into the position illustrated in FIG. 1. The bottom of the lever member 28 extends below the side walls 21, and is adapted to engage the bottom wall of the automatic teller machine when elevator is in its lower position, is illustrated in FIG. 2. As the tray and supporting bracket is lowered toward the bottom wall of the automatic teller machine, the extreme lower end 32 of the lever member 28 engages the bottom wall, and rotates in a counterclockwise direction, against the bias of the spring 29. A hook portion 34, formed in the upper end of the lever 28, surrounds the forward shaft 25 and urges it forwardly as lever 28 rotates counterclockwise. This urges the entire stop member 26 forwardly, and the shafts 24 and 25 follow the paths of the slots 22 until the shafts 24 and 25 have reached the bottom end of the slots 22, whereupon the tray drops to its lower position as illustrated in FIG. 2. It remains in this position only as long as the lever 28 is urged in its counterclockwise direction by engagement with the floor of the automatic teller machine. As the elevator rises from this position, the lever 28 rotates in a clockwise direction, under the urging of the spring 29, until the tray assumes the position illustrated in FIG. 1. It maintaines this position, with the tray approximately even with upper portion of its supporting bracket, until it reaches its extreme upper position, when the tray 15 is in the access compartment just below the access door.

Figure 4:
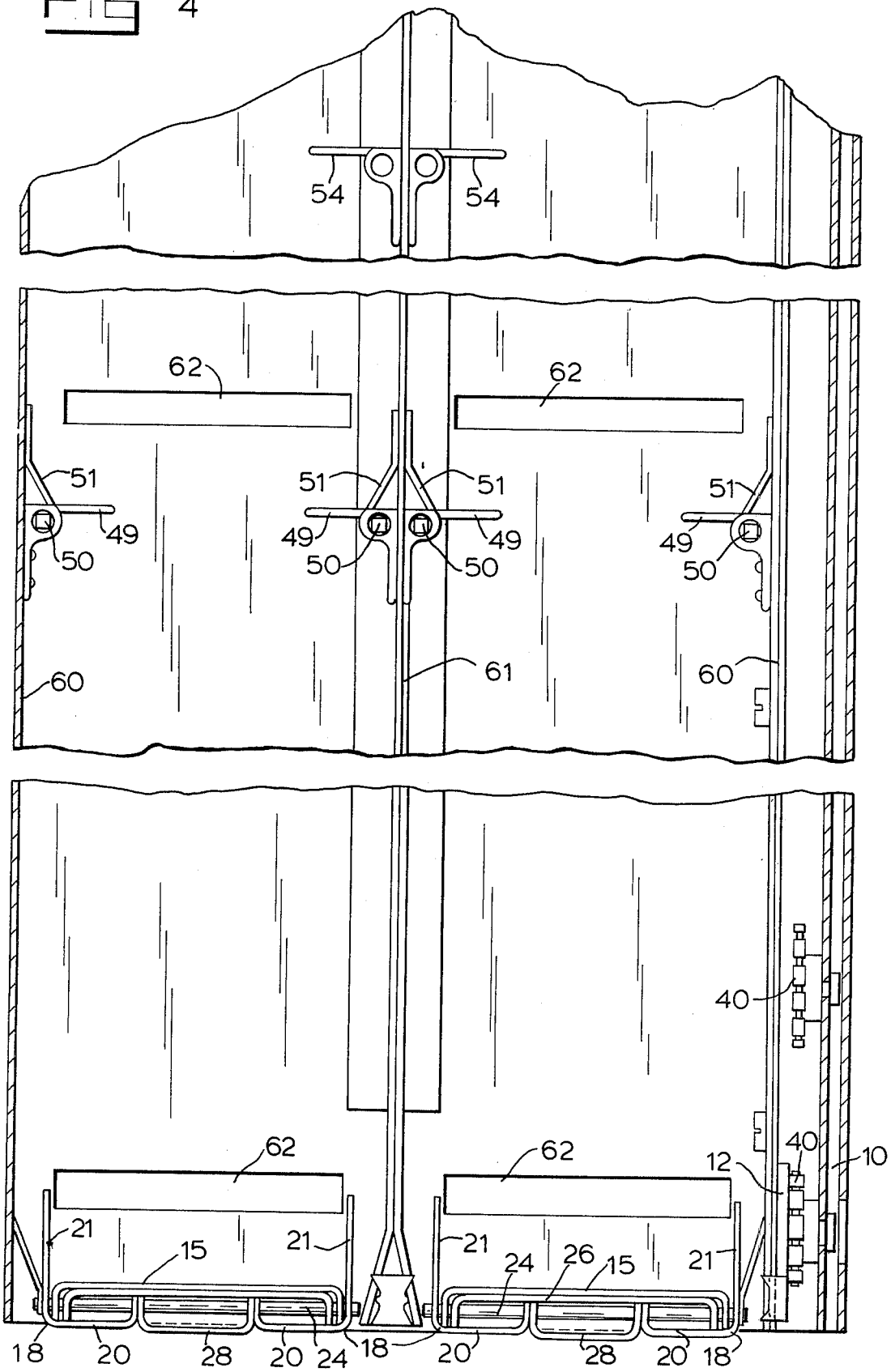
FIG. 4 is a vertical cross section of a portion, of an elevator assembly showing two trays, and illustrating the trays and brackets in cross section.

FIG. 4 illustrates how two trays are arranged in side-by-side relationship, each supported between a pair of bracket walls 21. The bracket walls 21 are all mounted to the transverse bar 16 (FIG. 3), so that both of the trays, together with their associated brackets and levers, are lifted as the slide member 12 is raised along the guide member 10. The power for raising the slide member 12 comes from a chain drive incorporating a chain 40. The chain is driven by a conventional motor and sprocket arrangement. As this kind of drive is well known in the art, it need not be described in detail.

It will be apparent that level-sensing switches (not shown) are employed where necessary to sense the location of the elevator at its extreme lower position and at its extreme upper position. It is necessary to determine when the elevator is at its extreme lower position, in order to allow energization of the dispensing modules which are disposed at the lowest elevation, so that they do not perform any dispensing operations until the elevator tray has reached its position beneath them. A third switch serves when the tray is in its tipping position as it is lowered, so the tray can be stopped there momentarily.

As shown in FIG. 4 a plurality of bill-supporting fingers 49 are inverted on the front and rear walls 60 defining the elevator compartment, and a center wall 61. The finger 49 are arranged for rotation relative to the walls. The fingers each have an L-shape cross section, and secured to each finger is a square shaft 50. Each shaft 50 is suitable supported for rotation (with its finger) relative to the wall and a flat leaf spring 51 bears on a flat section of the shaft 50, so as to form a detent, tending to maintain each finger 49 stationary position as illustrated. One leg of each finger 49 lies adjacent a vertical wall 60, while the other leg extends horizontally outwardly from the wall and is adapted to support one or more bills which are dispensed from a dispensing unit through a slot 62 located immediately above each pair of the fingers 49. The fingers 49 hold the bills in position until the tray 15 is raised into contact with the fingers, whereupon the fingers 49, with their shafts 50, rotate upwardly, allowing the tray to pass upwardly beyond the fingers. As rotated, one of the legs of the finger 49 is disposed upwardly against one of the vertical walls, with the other leg extending outwardly. This position is maintained by virtue of the leaf spring 51 bearing on the flat section of the shaft 50. As the tray 15 is lowered to its lower position, it engages the horizontal leg of each finger 49, which pivots downwardly to its original position as the tray passes below the finger. The fingers are thus returned to their initial position where they can receive and support additional bills dispensed by their respective dispensing units.

One additional sets of fingers 54 are supported in similar fashion on the central wall 61 between a pair of the fingers 49, but are not provided with leaf springs, so that as a tray moves upwardly pass the fingers 54, they immediately fall back to resume their normal positions as illustrated in FIG. 4. When the trays are lowered pass the fingers 54, they engage the bottom edge of the tray and tip it upwardly, rotating the tray about the shaft 24 about which is pivoted. This allows any bills which remains in position on the tray to slide downwardly off of the tilted tray, and, as described in the aforementioned Fish application, bills which are permitted to slide off the tray in this manner are received in an escrow compartment.

Referring now to FIG. 5, the door arrangement at the upper end of the elevator assembly is illustrated in side elevation view. The access door is pivoted about a pivot shaft 62 supported by a bracket (not shown) so that the surface of the door 60 is co-extensive with the upper surface of the housing 64. A hasp 66 is secured to the bottom surface of the door, and a tongue 68 is normally engaged in the hasp, to maintain the door in its lower position as illustrated in FIG. 5. The tongue 68 is supported for horizontal sliding movement relative to a pair of bracket members 70 and 72, as best illustrated in FIG. 6. The bracket members also define a vertical slide for guiding movement of a U-shape actuating member 74.

The tongue 68 is connected to a horizontal shaft 76, which is received in notches 78 of the guide members 70 and 72, and a pair of link members 80 are each connected from one end of the shaft 76 to one of a pair of pivots studs 82 secured to the actuateing member 74. The actuating member is normally urged downwardly by a pair of springs 76, connected between the studs 82 and the brackets 70 and 72 respectively.

The U-shaped actuating member is adapted to be engaged by a control block 81 secured to the chain drive, when the chain drive has raised the trays 15 nearly to their highest point. The block engages the actuating member 74 and urges it upwardly, which causes the link 80 to move the shaft 76 into the slot 78, thus withdrawing the tongue 68 from engagement with the hasp 66. As the actuating member 74 continues its upward motion, the tongue is completely withdrawn from the hasp, and the upper ends of the actuating member engage the lower sides of the door 60, raising it upwardly into open position. Thus, automatically, as the elevator reaches its upmost position, the door 60 is unlatched and then raised, to open the access area to allow the operator to withdraw the bills which are supported on the trays 15.

It is apparent from the foregoing that the elevator mechanism of the present invention functions economically and efficiently to collect and raise a plurality of bills which are dispensed, one at a time from bill dispensing mechanisms, unlocking and opening an access door at the top of the elevator assembly as it reaches the top. In addition, the tray supporting mechanism enables the trays to assume a position almost as low as the floor level of the automatic teller machine, and to assume a position above its supporting bracket in its upper position. In this way, the trays are assured of being beneath the lowest dispenser position, to receive bills dispensed thereby, and later present the bills at the top of the elevator assembly at the access compartment for withdrawal by the operator, without any interference from the supporting bracket, which at that time is beneath the level of the tray.

It will be appreciated that various modifications and additions may be made in the present invention without departing from the essential features and novelty thereof, which are intended to be defined and secured by the appended claims.

I claim as my invention:

1. A collector for an automatic teller machine, comprising means for supporting a relatively flat tray in a horizontal attitude, means for moving said tray along a vertical path of movement, a plurality of bill dispensers spaced along said path, an access compartment located at one end of said path, whereby said tray is adapted to collect bills dispensed from all of said bill dispensers at it moves along said path and to carry the collected bills to said access compartment, means for selectively tilting said tray to a tilted attitude, and means for tilting said tray during return movement along said path, said tilting means comprising a lever mounted for rotation about a horizontal axis, said lever being interposed in said vertical path and adapted to rotate about said axis during upward motion of said tray past said lever, and return rotation after said tray passes, said lever being adapted to not rotate in response to downward movement of said tray past said lever.

2. A collector for an automatic teller machine, comprising means for supporting a relatively flat tray in a horizontal attitude, means for moving said tray along a vertical path of movement, a plurality of bill dispensers spaced along said path, an access compartment located at one end of said path, whereby said tray is adapted to collect bills dispensed from all of said bill dispensers as it moves along said path and to carry the collected bills to said access ccmpartment, a door for selectively closing said access compartment, said door being mounted for pivoting about a horizontal axis, actuator means adapted to be moved by a member supported in fixed relation to said tray for opening said door as said tray reaches its one end position, means for mounting said tray on a horizontal shaft, bracket means having a generally vertical slot for receiving said shaft, means for urging said shaft toward the upper end of said slot, and means responsive to said tray approaching the lower limit of said path for moving said shaft toward the lower end of said slot, whereby the elevation of said tray is a minimum relative to said bracket means at the lower end of said path and a maximum at the upper end of said path.

3. The collector according to claim 2, including a stop member connected to said shaft and adapted to assume a fixed horizontal attitude, said tray adapted to rest on said stop member for normally assuming a horizontal attitude.

* * * * *